US006206464B1

(12) United States Patent
Santa Rosa et al.

(10) Patent No.: US 6,206,464 B1
(45) Date of Patent: Mar. 27, 2001

(54) ADJUSTABLE SUPPORT APPARATUS FOR A COMPUTER DATA INPUT DEVICE

(76) Inventors: Michael Santa Rosa, 6685 B Boca Pines Trail, Boca Raton, FL (US) 33433; Gilbert Santa Rosa, 11424 Whisper Sound Dr., Boca Raton, FL (US) 33428

( * ) Notice: Subject to any disclaimer, the term of this patent is extended or adjusted under 35 U.S.C. 154(b) by 0 days.

(21) Appl. No.: 09/398,134

(22) Filed: Sep. 17, 1999

(51) Int. Cl.[7] ..... A47B 39/00
(52) U.S. Cl. ..... 297/173; 297/188.18; 248/160
(58) Field of Search ..... 248/160; 297/153, 297/135, 173, 188.2, 188.14, 188.18

(56) References Cited

U.S. PATENT DOCUMENTS

| | | | |
|---|---|---|---|
| D. 410,453 | | 6/1999 | Timm . |
| 2,510,198 | | 6/1950 | Tesmer . |
| 3,408,032 | * | 10/1968 | Francis . |
| 3,926,392 | | 12/1975 | Davidson . |
| 4,779,884 | * | 10/1988 | Minati . |
| 4,946,180 | * | 8/1990 | Baer . |
| 5,033,528 | | 7/1991 | Volcani . |
| 5,135,189 | * | 8/1992 | Ghazizadeh . |
| 5,292,173 | * | 3/1994 | Lambert . |
| 5,299,874 | | 4/1994 | DeVoe . |
| 5,419,613 | * | 5/1995 | Wedeking . |
| 5,555,491 | | 9/1996 | Tao . |
| 5,653,499 | * | 8/1997 | Goodall . |
| 5,662,300 | | 9/1997 | Michelson . |
| 5,683,064 | | 11/1997 | Copeland et al. . |
| 5,690,307 | | 11/1997 | Joyce . |
| 5,730,408 | | 3/1998 | McAllister et al. . |
| 5,762,306 | | 6/1998 | Day . |
| 5,769,369 | | 6/1998 | Meinel . |
| 5,799,964 | * | 9/1998 | Chao . |
| 5,816,648 | * | 10/1998 | Baccili et al. . |
| 5,836,560 | | 11/1998 | Kaplan et al. . |
| 5,839,373 | | 11/1998 | Lin . |

* cited by examiner

*Primary Examiner*—Milton Nelson, Jr.
(74) *Attorney, Agent, or Firm*—Glenn E. Gold

(57) ABSTRACT

An adjustable platform support assembly is provided for supporting a computer input device such as a keyboard, mouse or the like. Each support platform (40,50) is directly attached to a length of flexible gooseneck shaft (30,32) which, in turn, is attached to a coupling assembly (20). The coupling assembly is particularly designed to provide secure attachment to an arm of (12,14) of a chair (10). The assembly enables a computer operator to swivel and/or recline in the chair without having to readjust the platform position.

5 Claims, 4 Drawing Sheets

ADJUSTABLE SUPPORT APPARATUS FOR A COMPUTER DATA INPUT DEVICE

FIELD OF THE INVENTION

This invention relates generally to adjustable supports, and more particularly to an adjustable platform assembly for supporting a data input device, such as a computer keyboard, mouse or the like, and adapted for releasable attachment to an armchair.

BACKGROUND OF THE INVENTION

Personal computers are becoming more and more common in both home and work environments. Such systems typically employ a keyboard, mouse and/or other data entry devices. Due to space constraints on the desk top, it is often difficult to locate the keyboard thereon. Furthermore, many computer operators do not prefer to locate the keyboard on the desk top because it is uncomfortable to address the keyboard. For example, computer operators often complain of hand, wrist, back and neck discomfort during data entry.

In response to the aforementioned problems, various mechanical assemblies have been developed for supporting data input devices, such as keyboards, at locations other than the desk top. Conventionally, such assemblies have been designed to be mechanically fastened to the underside of a desk or table top, and include a retractable keyboard support tray. For instance, U.S. Pat. Nos. 5,836,560 and 5,839,373 are representative of typical retractable keyboard support assemblies. In each of the aforementioned representative patents, the disclosed assemblies are provided with means for adjusting the position and/or orientation of the keyboard support in an effort to reduce operator discomfort during data entry. In particular, the disclosed assemblies enable the user to adjust the keyboard position and/or orientation based upon the seated position of the user. However, these structures have inherent drawbacks. Significantly, the fixed position of the keyboard support relative to the desk or table requires the operator to repeatedly readjust the keyboard support position and/or orientation upon shifting the position and/or orientation of the user's chair. Furthermore, the aforementioned support structures are intended to be permanently installed at a single computer station using complicated, multi-component mounting hardware. Consequently, the mechanical fastening means required for attaching the aforementioned structures to the desk severely restrict their portability.

U.S. Pat. No. 5,762,306 addresses the portability limitation of the aforementioned structures by incorporating a conventional clamp assembly specifically designed for manual attachment to a desk or table top. However, the structure disclosed in the '306 patent does not overcome the former limitation; namely, the attachment of the keyboard support platform to the desk or table requires that the user reposition and/or reorient the support platform upon altering the position and/or orientation of the user's chair.

Accordingly, there is a recognized need for an improved support structure for computer data input devices which overcomes the aforementioned limitations of conventional support structures.

SUMMARY OF THE INVENTION

It is an object of the present invention to provide an adjustable support assembly for supporting a computer data input device such as a keyboard or a mouse.

It is another object of the present invention to provide an adjustable support assembly particularly adapted for attachment to an arm of a chair, thereby enabling the user to swivel and/or recline in said chair without having to adjust the support assembly.

It is yet another object of the present invention to provide a portable support assembly having a structure which enables the assembly to be attached to, and detached from, an armchair with minimal effort.

It is still another object of the present invention to provide an adjustable support system for supporting at least two individual input devices, such as a keyboard and mouse, wherein separate platform support components of said system are adapted for being releasably attached to one another.

These and other objects are achieved with the present invention in which an adjustable computer input device support system particularly adapted for attachment to an armchair generally comprises an input device support platform 40 connected by an adjustable jointed shaft 30 to an armchair coupling assembly 20. Coupling assembly 20 includes a rigid base member 22 having upper and lower portions, 23 and 24, respectively, a clamping member 28, and a threaded screw member 29.

Threaded screw member 29 extends through and engages a threaded aperture 26 extending completely through lower portion 24 of base member 22. Preferably, clamping member 28 is freely attached to the distal end of screw member 29, thereby enabling rotation of screw member 29 without corresponding rotation of clamping member 28. Clamping member 28 is urged toward upper portion 23 of base member 22 by rotating threaded adjustment member 29. Upper surface 27 of clamping member 28 engages the underside of chair arm 12 while inner surface 25 of base member upper portion 23 engages the upper surface of chair arm 12. The contact surfaces of the base and clamping members can be provided with friction enhancing means.

Coupling assembly 20 is connected to a support platform 40 by a flexible jointed steel shaft 30, commonly referred to as a gooseneck shaft, which is bendable and when bent will remain in the new position. Preferably, gooseneck shaft 30 is provided with a first end threaded and sized for mating with a corresponding threaded aperture in base member 22 of coupling assembly 20.

The second end of gooseneck shaft 30 is preferably sized for being snugly received by an aperture 45 extending longitudinally through a thickened section 46 of support platform 40. Preferably, aperture 45 extends longitudinally through a majority of the length of section 46 of support platform 40. The snug fit prevents the support platform 40 from inadvertently slipping against the gooseneck shaft 30 while the operator is addressing the supported input device, yet enables the support platform to be forcibly rotated about the gooseneck shaft if desired. In particular, the snug fit enables the operator to adjust the degree of tilt of the support platform 40 by rotating the platform about the central axis of gooseneck shaft 30, while gripping an exposed length of the gooseneck shaft proximate aperture 45.

In an alternate embodiment of the present invention, a pair of support platforms 40 and 50, connected to chair arms 12 and 14, respectively, are provided with means for being releasably attached to one another. Preferably, an outwardly-extending tongue member 48 of support platform 40 is sized and shaped for being snugly received within channel 58 of adjacent support platform 50. The attachment provides adequate mechanical stability to prevent the adjacent platforms 40, 50 from inadvertently detaching or twisting with respect to one another. Furthermore, the weight bearing capacity of each support platform is increased due to the added support provided, via the connection, by the adjacent support platform assembly.

DETAILED DESCRIPTION OF THE PREFERRED EMBODIMENTS

Figure 1:
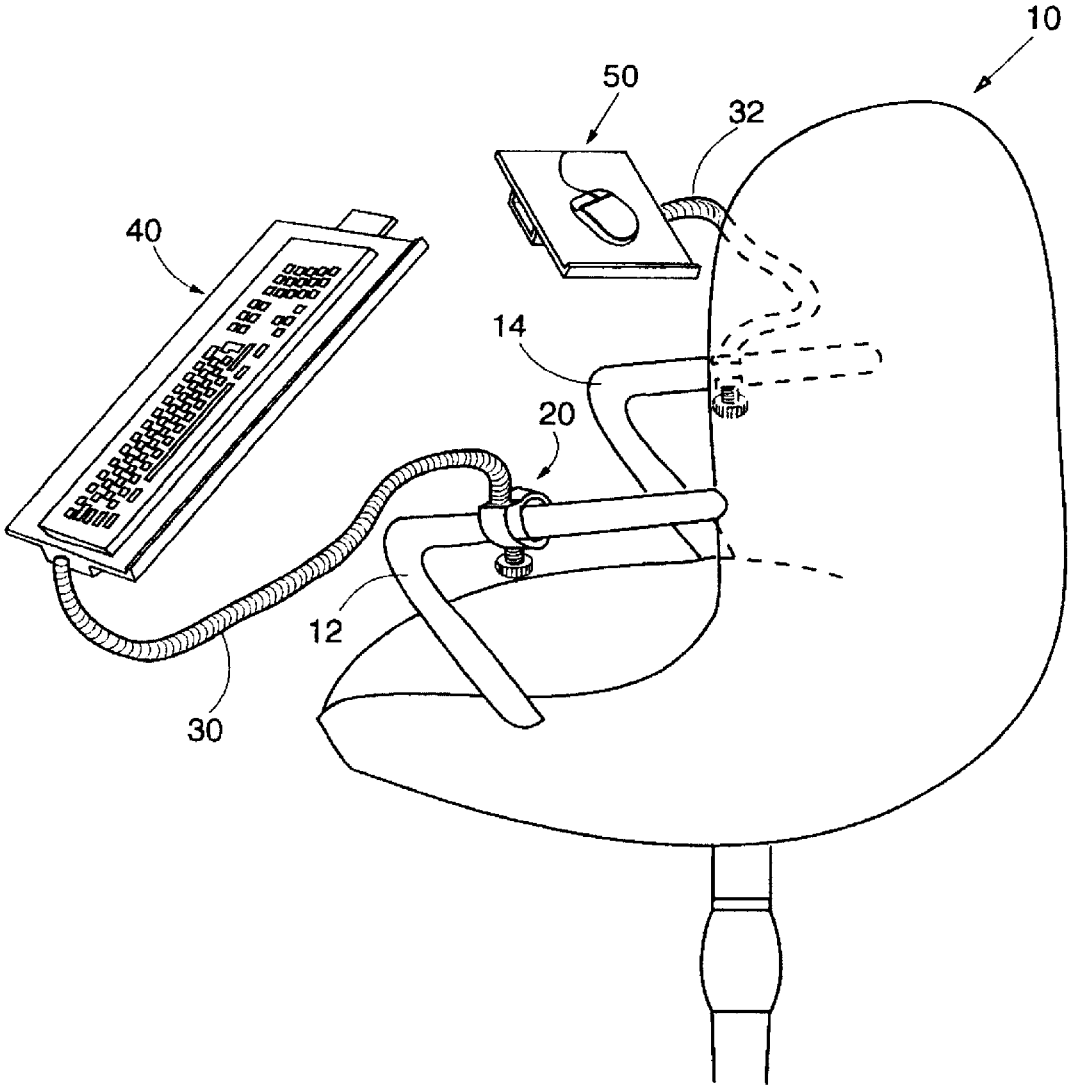
FIG. 1 illustrates an adjustable support system in a fully-assembled state, in accordance with the present invention.
Figure 2:
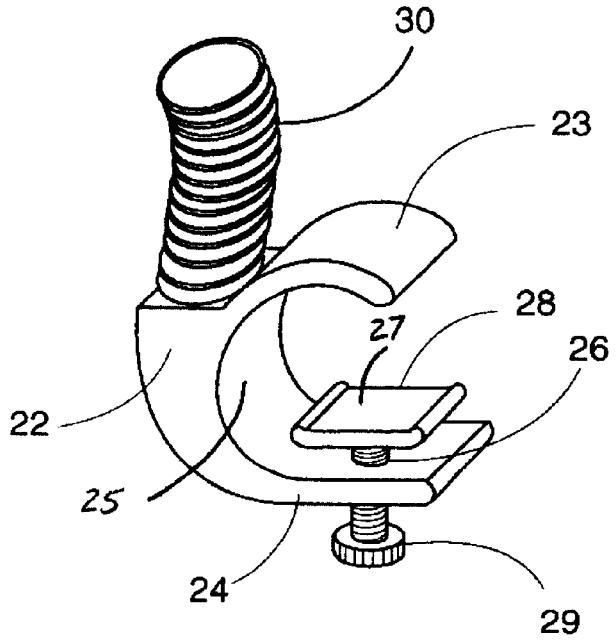
FIG. 2 is an isometric view of a clamp assembly in accordance with a preferred embodiment of the present invention.
Figure 3:
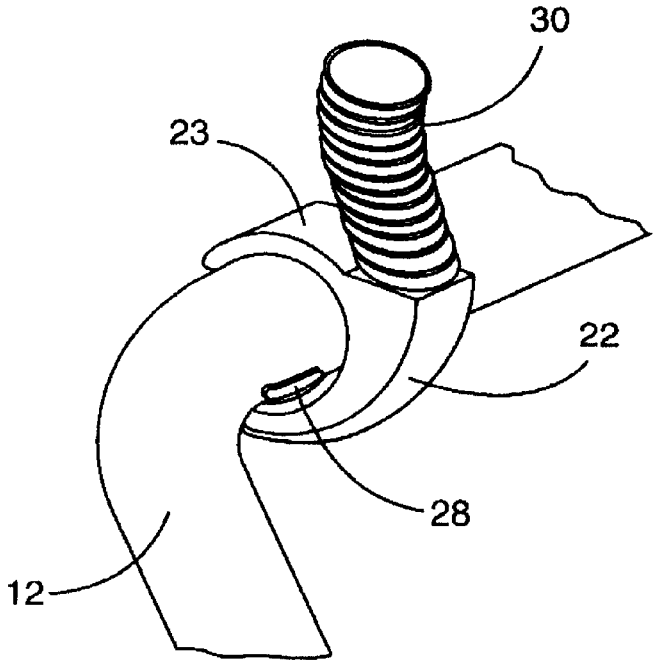
FIG. 3 is an illustration of the clamp assembly of FIG. 2 attached to an arm of a chair.

Referring now to FIGS. 1–3, an adjustable computer input device support system particularly adapted for attachment to an armchair generally comprises an input device support platform 40 connected by an adjustable jointed shaft 30 to an armchair coupling assembly 20. The support system illustrated in FIG. 1 depicts two individual support assemblies coupled to individual arms 12 and 14 of chair 10. Except where otherwise noted herein, the individual support assemblies have identical structures. Consequently, an understanding of the invention can be had by reference to a single support assembly. Accordingly, for the purpose of the following discussion, reference will be made particularly to the assembly coupled to chair arm 12.

Significantly, coupling assembly 20 is particularly suited for attachment to an arm of a chair. Coupling assembly 20 includes a unitary base member 22 having upper and lower portions, 23 and 24, respectively, a clamping member 28, and a threaded screw member 29. Base member 22 is constructed to provide sufficient strength and rigidity to support adjustable jointed shaft 30 and support platform 40. Preferably, base member 22 is constructed from metal; however, alternate materials are possible. For example, base member 22 can be molded from a rigid plastic material.

Threaded screw member 29 extends through and engages a threaded aperture 26 extending completely through lower portion 24 of base member 22. Preferably, clamping member 28 is freely attached to the distal end of screw member 29, thereby enabling rotation of screw member 29 without corresponding rotation of clamping member 28. In operation, clamping member 28 is initially provided in a retracted position to enable the assembly to be loosely fitted around chair arm 12. Subsequently, clamping member 28 is urged toward upper portion 23 of base member 22, by rotating threaded adjustment member 29, until assembly 20 is tightly coupled to chair arm 12.

As illustrated in FIG. 3, when properly coupled to the chair arm, upper surface 27 of clamping member 28 engages the underside of chair arm 12 while inner surface 25 of base member upper portion 23 engages the upper surface of chair arm 12. Preferably, coupling assembly 20 is adequately tightened to minimize slipping of surfaces 25 and 27 against the outer surface of the chair arm. In instances where further protection against inadvertent slipping is desired, inner surface 25 of base member 22, and upper surface 27 of clamping member 28 are provided with friction enhancing means. It will be apparent to those skilled in the art that various means for providing enhanced friction between the clamping assembly 20 and the chair arm 12 are possible. For instance, surfaces 25 and 27 can be roughened or constructed having integral friction enhancing structures, such as raised bumps and ridges. Alternatively, surfaces 25 and 27 can be provided with a layer of friction enhancing material, such as rubber, disposed thereon.

Although a particular base member geometry is illustrated in FIGS. 1–3, it will be apparent to those skilled in the art that the geometry of the base member 22 may vary to conform to the particular chair arm shape or geometry. In contrast to conventional C-clamps used for coupling to planar surfaces, such as table tops and desk tops, the present invention incorporates a wraparound coupling device geometry extending beyond the upper and lower surfaces of arm 12 to prevent the coupling assembly 20 from being inadvertently detached from the chair arm.

Coupling assembly 20 is connected to a support platform 40 by a flexible jointed steel shaft 30, commonly referred to as a gooseneck shaft, which is bendable and when bent will remain in the new position. Preferably, gooseneck shaft 30 is provided with a first end threaded and sized for mating with a corresponding threaded aperture in base member 22 of coupling assembly 20. However, as will be apparent to those skilled in the art, alternate means of attachment may be suitable. For instance, where coupling assembly base member 22 is constructed from a plastic material, the first end of gooseneck shaft 30 can be directly molded into the base member 22. Regardless of the means of attachment, it is preferred that the first end of gooseneck shaft 30 attaches directly to base member 22 of the coupling assembly 20.

Figure 4:
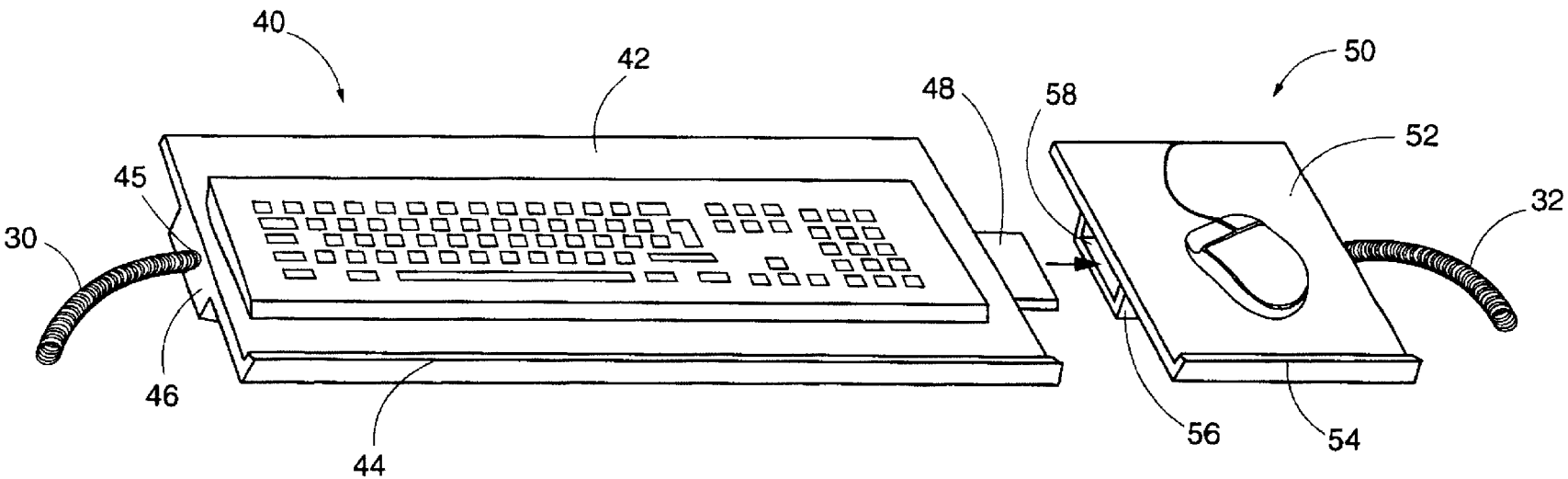
FIG. 4 is a left top front isometric view of a pair of interlocking input device support platforms, in accordance with an alternate embodiment of the present invention.
Figure 5:
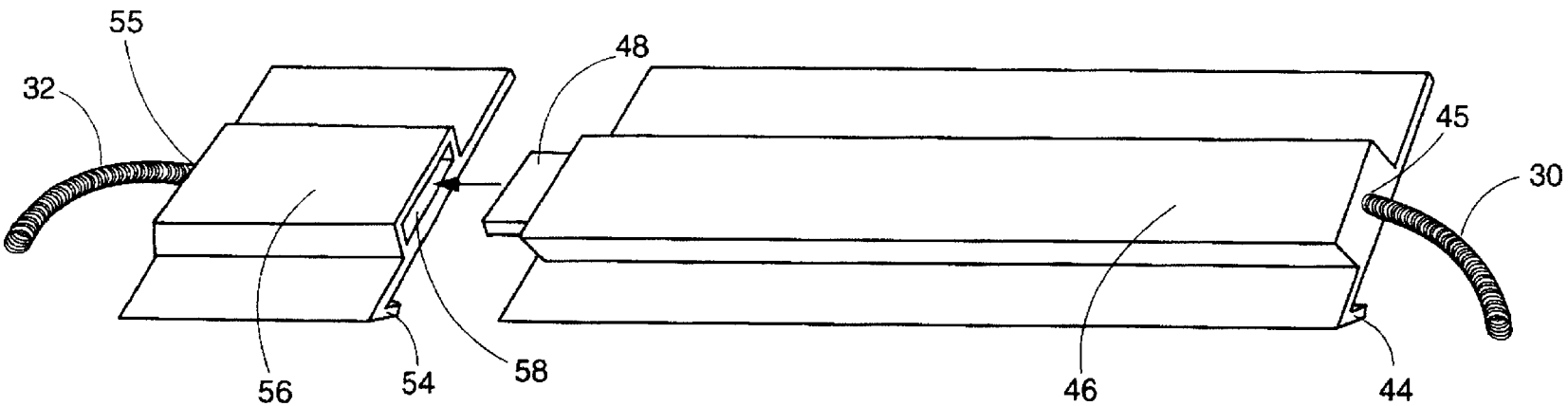
FIG. 5 is a bottom view of the interlocking support platforms depicted in FIG. 4.

Referring now to FIGS. 4–5, the second end of gooseneck shaft 30 is preferably sized for being snugly received by an aperture 45 extending longitudinally through a thickened section 46 of support platform 40. Longitudinally extending aperture 45 forms a channel (not shown) for receiving a corresponding length of the gooseneck shaft 30. Preferably, aperture 45 extends longitudinally along a majority of the length of section 46 of support platform 40. In this manner, the corresponding length of gooseneck shaft 30 snugly inserted therein provides additional support for platform 40. Preferably, the snug fit provides adequate friction between the outer surface of the inserted length of gooseneck shaft 30 and the channel wall to prevent the support platform 40 from inadvertently sliding along, or rotating about, the gooseneck shaft while the operator is addressing the supported input device. However, it is also preferred that the friction between gooseneck shaft and channel wall enables the support platform to be forcibly rotated about the gooseneck shaft if desired. In particular, the snug fit enables the operator to adjust the degree of tilt of the support platform 40 by rotating the platform about the central axis of gooseneck shaft 30, while gripping an exposed length of the gooseneck shaft proximate aperture 45.

As will be apparent to those skilled in the art, numerous alternate means for attaching gooseneck shaft 30 to the support platform are possible. For example, the second end of gooseneck shaft 30 and the internal surface of the support platform channel can have threaded or snap-fitting structures. Furthermore, an auxiliary coupling component can be employed for providing a connection between gooseneck shaft 30 and support platform 40. Regardless of the means of attachment employed, it is preferred that gooseneck shaft 30 attaches to support platform 40 in a manner which prevents the gooseneck shaft from physically contacting the body of a seated user. In that respect, the peripheral attachment of the gooseneck shaft 30 to the support platform 40 in the present invention is significant since it prevents the gooseneck shaft from extending beneath the support platform and interfering with the legs of the seated computer operator.

Still referring to FIGS. 4–5, in an alternate embodiment of the present invention, a pair of support platforms 40 and 50, connected to chair arms 12 and 14, respectively, are provided with means for being releasably attached to one another. Preferably, an outwardly-extending tongue member 48 of support platform 40 is sized and shaped for being snugly received within channel 58 of adjacent support platform 50. As will be apparent to those skilled in the art, numerous alternate means of temporary attachment are possible, including interlocking components, snap-fitting components, and magnetic components, to name just a few. It is preferred that the support platform attachment means employed provides adequate mechanical stability to prevent the adjacent platforms 40, 50 from inadvertently detaching or rotating with respect to one another. Significantly, the connection of adjacent support platforms provides improved mechanical stability. More specifically, the weight bearing capacity of each support platform is increased due to the added support provided at the connector end of the support platform.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. An adjustable support assembly for a computer data input device, the support assembly attachable to an arm of a chair, comprising:

a first support platform sized and shaped for supporting said computer data input device, said first support platform including a thickened section extending downwardly from a bottom surface thereof and having a channel extending therethrough;

a coupling subassembly particularly adapted for being securely attached to said chair arm; and an adjustable jointed shaft member having first and second ends, the first end attached to said coupling subassembly and the second end received through said first support platform channel, said jointed shaft member infinitely bendable along substantially its entire length and having sufficient flexibility to enable said jointed shaft to be manually conformed to a desired shape and position, yet adequately rigid to maintain said desired shape and position while supporting said computer data input device, wherein upon moving said chair, the desired position and orientation of said support platform relative to said chair is maintained.

2. An adjustable support assembly for a computer data input device, the support assembly attachable to an arm of a chair, comprising:

a first support platform sized and shaped for supporting said computer data input device, said first support platform having an integral tongue member sized and shaped for being received within a corresponding channel of a second support platform;

a coupling subassembly particularly adapted for being securely attached to said chair arm; and an adjustable jointed shaft member having first and second ends, the first end attached to said coupling subassembly and the second end directly attached to said support platform, said jointed shaft member infinitely bendable along substantially its entire length and having sufficient flexibility to enable said jointed shaft member to be manually conformed to a desired shape and position, yet adequately rigid to maintain said desired shape and position while supporting said computer data input device, wherein upon moving said chair, the desired position and orientation of said support platform relative to said chair is maintained.

3. An adjustable support assembly for a computer data input device, the support assembly attachable to an arm of a chair, comprising:

a first support platform sized and shaped for supporting said computer data input device;

a coupling subassembly particularly adapted for being securely attached to said chair arm; and an adjustable jointed shaft member having first and second ends, the first end attached to said coupling subassembly and the second end directly attached to said support platform, said jointed shaft member infinitely bendable along substantially its entire length and having sufficient flexibility to enable said jointed shaft member to be manually conformed to a desired shape and position, yet adequately rigid to maintain said desired shape and position while supporting said computer data input device, said coupling subassembly including:

a C-shaped base member having an upper portion, a lower portion, and a thickened middle portion, said thickened middle portion adapted for attachment to the first end of said jointed shaft member, and said lower portion having a threaded aperture extending therethrough;

a threaded screw member having a near end and a distal end, the near end having a knob portion for rotating said screw member, the distal end extending through said threaded aperture into an interior portion of said C-shaped base member; and a clamping member attached to the distal end of said threaded screw member and freely rotatable about said distal end such that rotation of said screw member does not necessitate a corresponding rotation of said clamping member, wherein upon moving said chair, the desired position and orientation of said support platform relative to said chair is maintained.

4. An adjustable support assembly for a computer data input device, the support assembly attachable to an arm of a chair, comprising:

a first support platform sized and shaped for supporting said computer data input device;

a coupling subassembly particularly adapted for being securely attached to said chair arm; and an adjustable jointed shaft member having first and second ends, the first end attached to said coupling subassembly and the second end directly attached to said support platform, said jointed shaft member infinitely bendable along substantially its entire length and having sufficient flexibility to enable said jointed shaft member to be manually conformed to a desired shape and position, yet adequately rigid to maintain said desired shape and position while supporting said computer data input device, said coupling subassembly including:

a C-shaped base member having an upper portion having an interior surface shaped to conform to an upper surface of said chair arm, a lower portion, and a thickened middle portion, said thickened middle portion adapted for attachment to the first end of said jointed shaft member, and said lower portion having a threaded aperture extending therethrough;

a threaded screw member having a near end and a distal end, the near end having a knob portion for rotating said screw member, the distal end extending through said threaded aperture into an interior portion of said C-shaped base member; and a clamping member attached to the distal end of said threaded screw member and freely rotatable about said distal end such that rotation of said screw member does not necessitate a corresponding rotation of said clamping member, an upper surface of said clamping member shaped to conform to a lower surface of said chair arm, wherein upon moving said chair, the desired position and orientation of said support platform relative to said chair is maintained.

5. An adjustable support assembly adapted for attachment to a chair having first and second arms, the adjustable support assembly comprising:

first and second support platforms having means for being releasably attached to one another;

a first jointed shaft member having a first end attached to said first support platform and a second end having means for being coupled to said first chair arm; and a second jointed shaft member having a first end attached to said second support platform and a second end having means for being coupled to said second chair arm.

* * * * *